US005331528A

United States Patent [19]

Chen

[11] Patent Number: 5,331,528

[45] Date of Patent: Jul. 19, 1994

[54] FLASHLIGHT

[76] Inventor: Chin-Hsiang Chen, No. 32, Lane 398, Sec. 2, Fu Chiang Road, Yung Kang Hsiang, Tainan Hsien, Taiwan

[21] Appl. No.: 42,594

[22] Filed: Apr. 2, 1993

[51] Int. Cl.[5] ..... F21L 7/00

[52] U.S. Cl. ..... 362/205; 362/184; 362/202

[58] Field of Search ..... 362/188, 205, 206, 187, 362/197, 203, 184, 202; 200/60

[56] References Cited

U.S. PATENT DOCUMENTS 3,924,117 12/1975 Brindley ..... 362/205
4,286,311 8/1981 Maglica ..... 362/205
4,388,673 6/1983 Maglica ..... 362/205
4,527,223 7/1985 Maglica ..... 362/205
4,951,183 8/1990 Wang ..... 362/205

*Primary Examiner*—James C. Yeung
*Attorney, Agent, or Firm*—Pro-Techtor International

[57] ABSTRACT

A flashlight comprising a metal lamp base and a plastic lamp base threably combined with a front end of a tubular elongate body for mounting a lamp of different style, a switch base havint a push button to protrude up through a hole in the body to be deposited in the body and two conductors on both sides of the push button to turn on or off electricity coming from batteries deposited in the body behind the switch base.

4 Claims, 7 Drawing Sheets

FLASHLIGHT

BACKGROUND OF THE INVENTION

A conventional flashlight shown in FIG. 10 comprises quite a large number of components, having a high cost and the drawbacks of the possibility of malfunction of a push button, a spring, etc., in addition to the impossibility to make lamps of different styles.

SUMMARY OF THE INVENTION

This invention has been devised to offer a flashlight having fewer components than a conventional flashlight and having the versatility to enable construction of lamps of different styles.

One feature of this flashlight is a switch base having a push button protruding up through a push button hole in a tubular elongate body which contains the switch base and batteries.

Another feature is the tubular elongate body having projecting points in an inner surface to fit in an annular groove in an intermediate portion of the switch base. The switch base and the body can thus be assembled quickly and easily.

Another feature is the switch base consisting of two semi-circular bodies, and having a push button unit with two conductors, one on either side of the push button unit. One conductor extends backward to contact a conductive point of a battery, and the other conductor contacts a conductive point of a lamp urged by a spring.

Another feature is the provision of a plastic lamp base of a disk shape. The lamp base has a conductor in a groove in a front surface and a conductive tubular bar extending rearward for a plug-in lamp to be mounted on.

Another feature is a metal disk-shaped lamp base engaging a front end of the tubular body and having a female thread to engage a male threaded lamp.

One more feature is a straight diametric groove provided in the lamp base for a driver or a coin to fit into to facilitate turning the base.

DETAILED DESCRIPTION OF THE INVENTION

Figure 1:
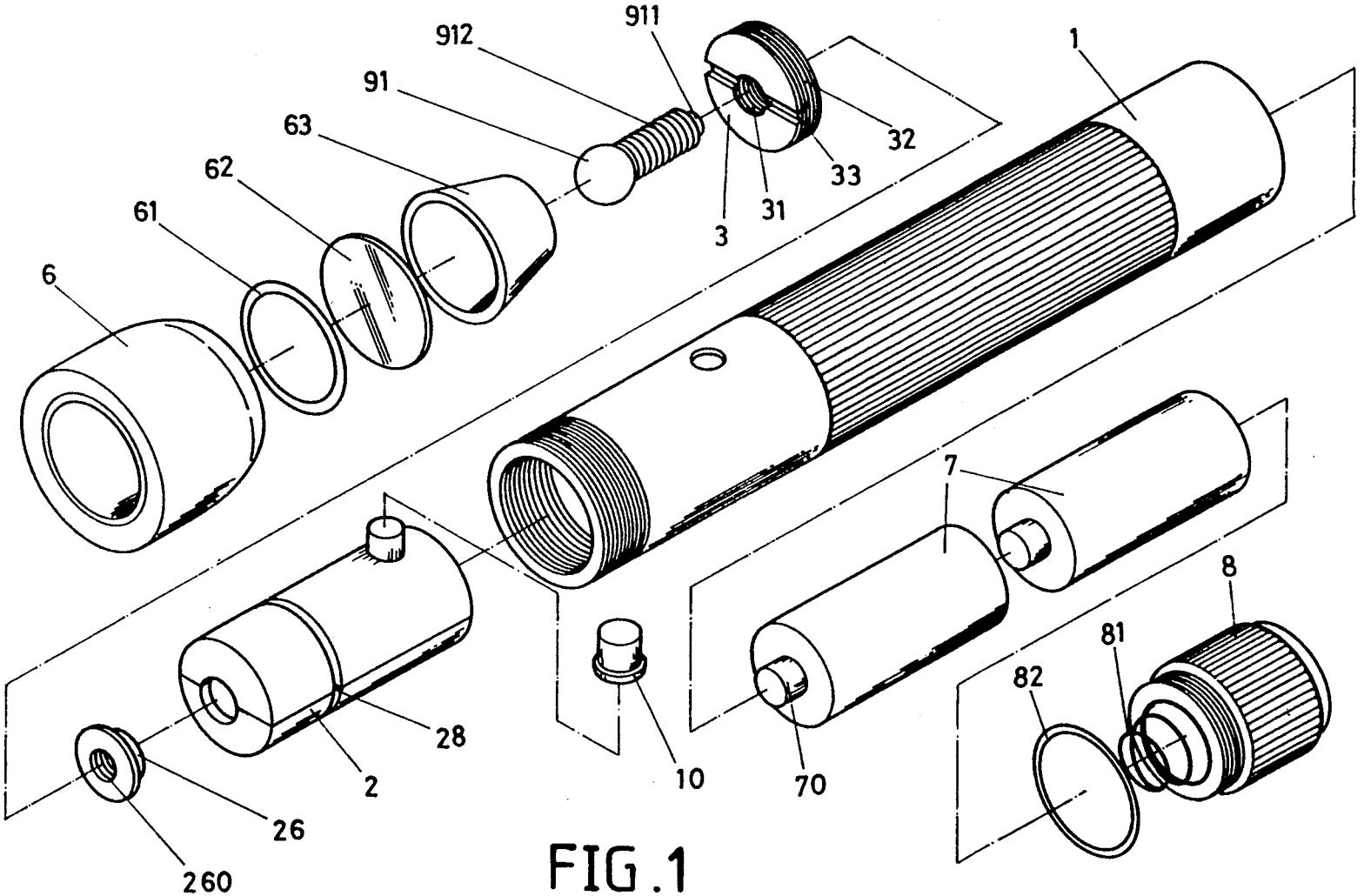
FIG. 1 is an exploded perspective view of a flashlight of the present invention.

A flashlight according to the present invention as shown in FIG. 1, comprises a tubular elongate body 1, a switch base 2, a metal lamp base 3, a plastic lamp base 4, a head 6, and a tail cap 8 as its main components.

Figure 2:
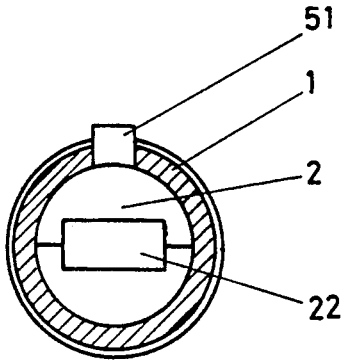
FIG. 2 is a cross-sectional view of the flashlight of the present invention.
Figure 3:
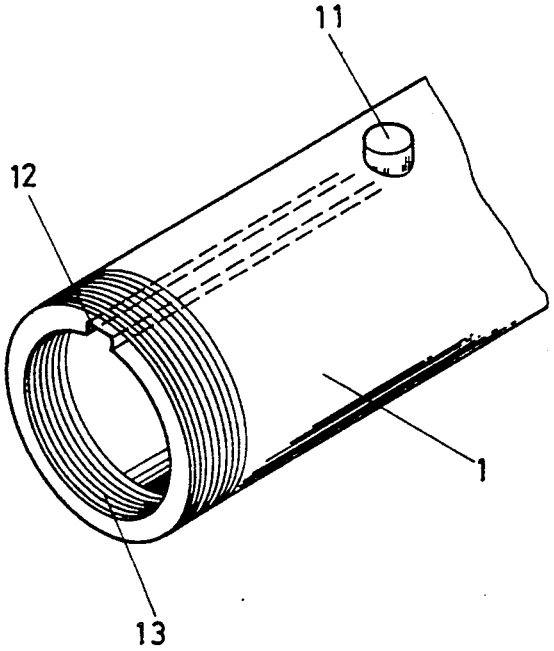
FIG. 3 is a perspective view of a tubular elongate body of the flashlight of the present invention.

The tubular elongate body 1, as shown in FIGS. 1-3, has a push button hole 11, and an inner straight groove extending from an outer end to the push button hole 11. A push button 51 fits into and moves along the groove so that the switch base 2 can be inserted into the body 1. The button 51 extends up through the hole 11 above the outer body surface and is covered with a button cap 10. A female thread in the inner surface of the outer end engages the metal lamp base 3 and the plastic lamp base 4.

Figure 4:
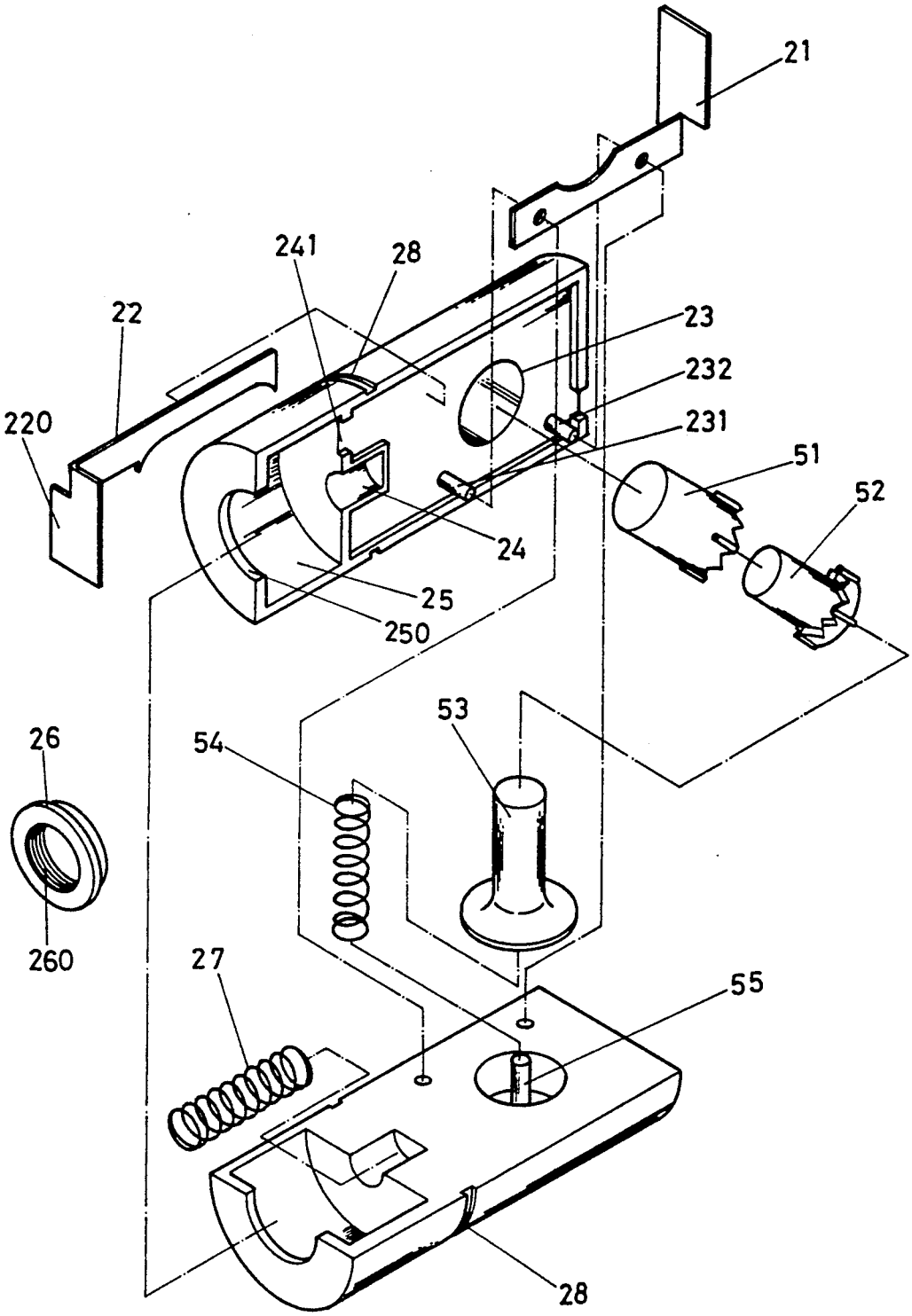
FIG. 4 is an exploded perspective of a switch base of the flashlight in the present invention.
Figure 5:
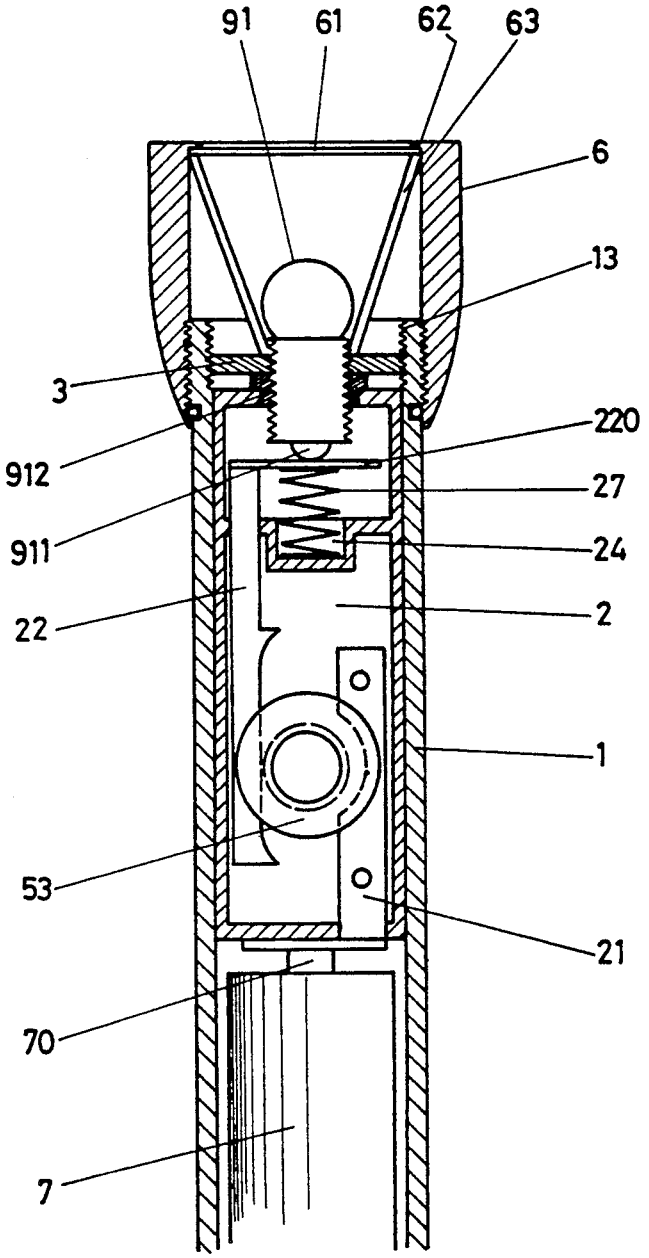
FIG. 5 is a cross-sectional view of the switch base and the head of the flashlight of the present invention.

The switch base 2, as shown in FIGS. 1, 4 and 5, consists of an upper semi-circular half body and a lower semi-circular half body. The switch base an annular groove 28 in the intermediate section of both the upper and the lower half bodies. The upper body includes projections 231, 232 that mate with holes in the lower body so that the two bodies mesh to form the switch base 2. The switch base 2 further includes a push button 51, a rotatable cylinder 52, a guide cylinder 53, and a spring 54 which fit into a locating post 55 in a rear portion of the switch base 2. The switch base also includes an internal cavity 250 in a front portion 25 and a spring groove 24 in the intermediate potion in both half bodies for receiving a spring 27. A notch 241 above the spring groove 24 in the upper half body receives an L-shaped conductor 22. The bent contact portion 220 of the L-shaped conductor 22 inserts into the front portion of the switch base 2 in contact with the front end of the spring 27 so as to be urged against a conductive point 911 or 912 of a screw-in lamp 91 or fit-in lamp 92, or to be urged against a conductive bar 43 of the plastic lamp base 4 in the inner cavity 250 in the front portion 25. A metal locating ring 26 has a female thread 260 to engage a male thread 32 of the metal lamp base 3, enabling a male thread 912 of the screw-in lamp 91 to engage a female thread hole 31. When the metal locating ring 26 is combined with the fit-in lamp 92, the ring 26 together with the vase 3 pinch a round disc 922 of the lamp 92, assuring a good electrical contact.

The metal lamp base 3, as shown in FIGS. 1, 5 7 and 9, has a female thread hole 31 to engage the conductive male thread 912 of the lamp 91, a male thread 32 to engage the female thread 13 of the body 1, and a straight diametric groove 33 for a driver or a coin to fit into so that the lamp base 3 may be screwed into and out of the body 1.

Figure 6:
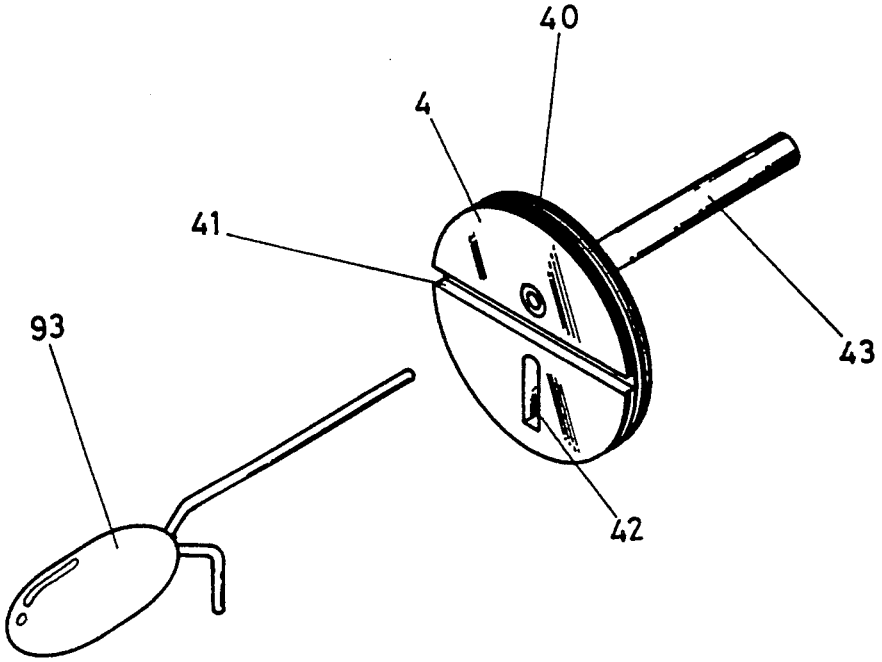
FIG. 6 is a perspective view of a plastic lamp base and a plug-in lamp of the present invention.
Figure 7:
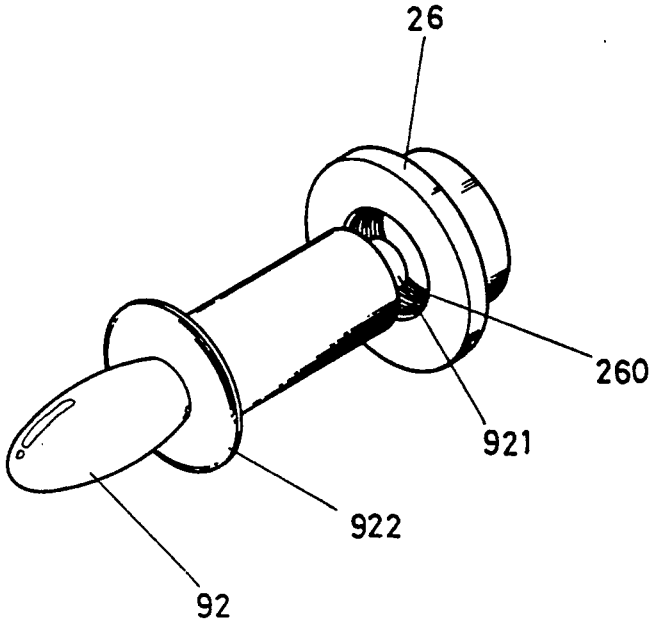
FIG. 7 is a perspective view of a locating ring of the switch base and a fit-in lamp of the present invention.
Figure 8:
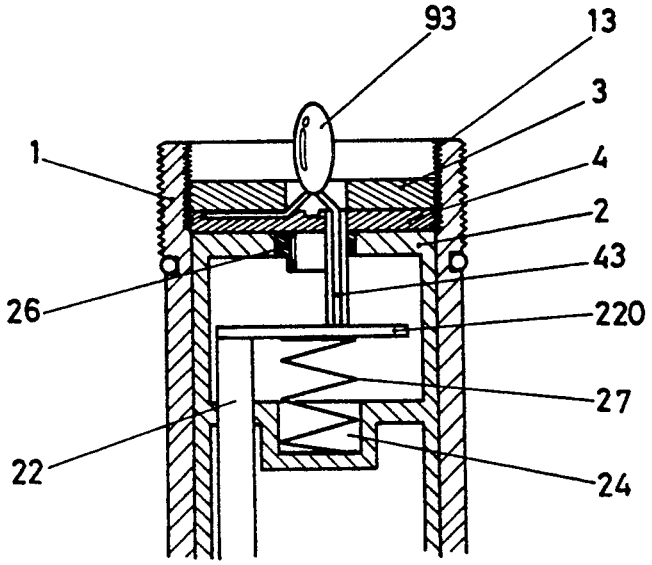
FIG. 8 is a cross-sectional view of the plug-in lamp fixed in the switch base combined with the plastic lamp base of the present invention.
Figure 9:
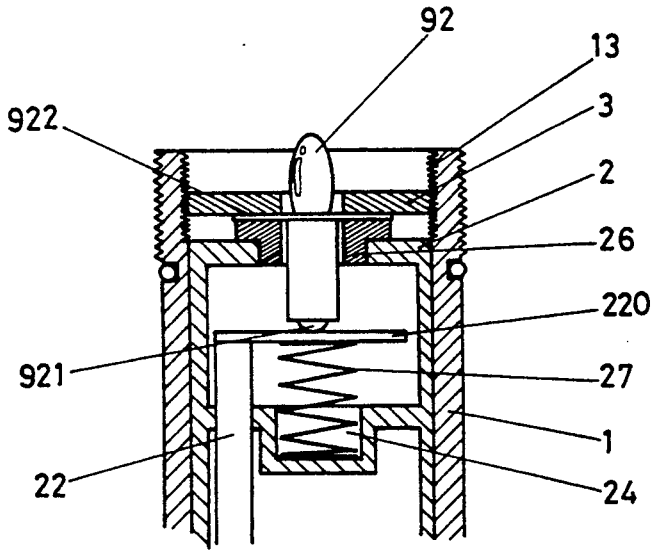
FIG. 9 is a cross-sectional view of the fit-in lamp fixed in the switch base combined with the plastic lamp base of the present invention.
Figure 10:
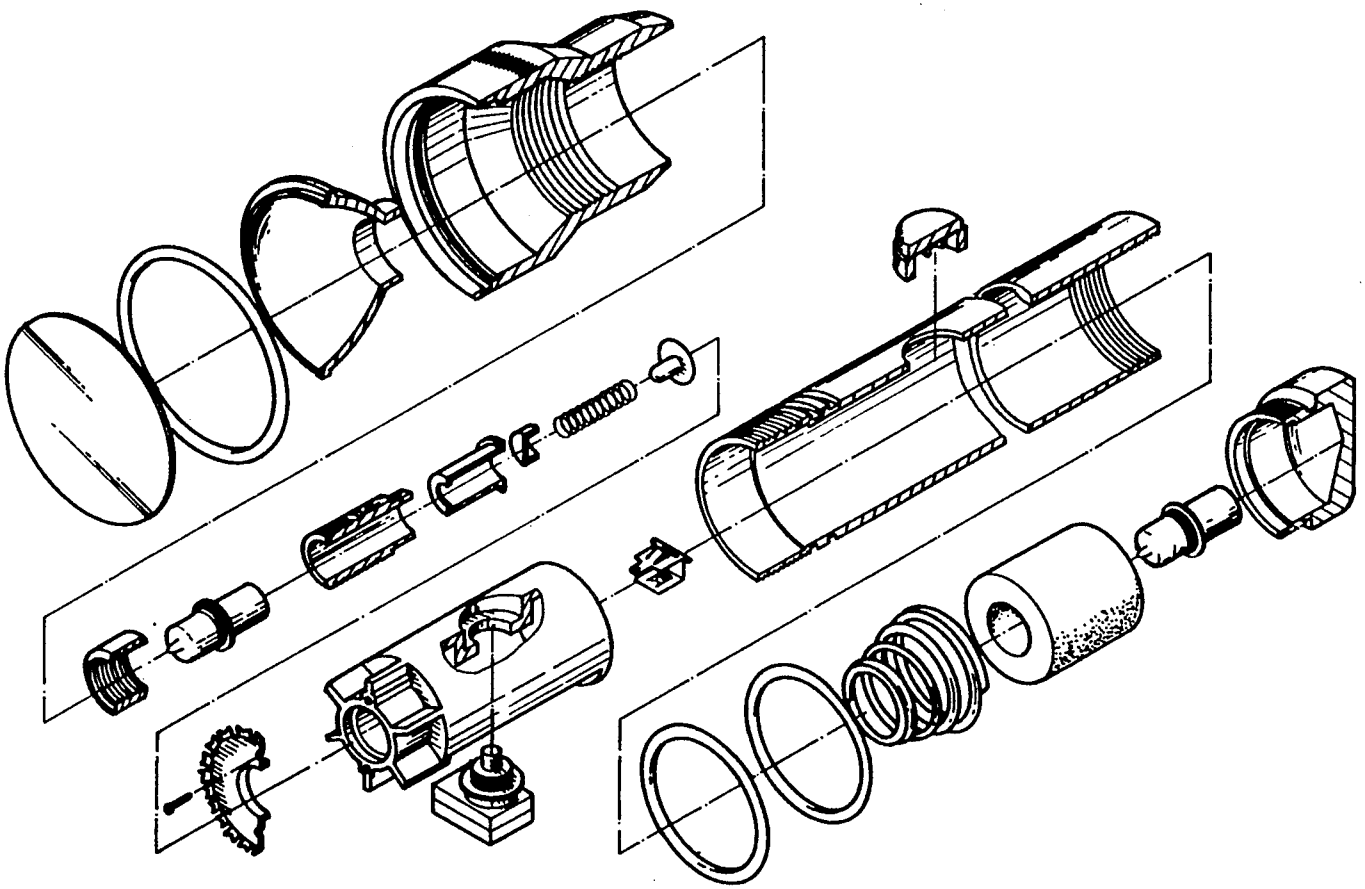
FIG.10 (PRIOR ART)
FIG. 10 is an exploded perspective view of a conventional flashlight.

The plastic lamp base 4, as shown in FIGS. 6 and 8, has a male thread 40, a straight diametric groove 41, a conductor 42 and a conductive tubular bar 43 extending rearward from a rear surface for receiving a plug-in lamp 93 having a long pole and a bent pole to fit into the bar 43 and the groove 41. The conductor 42 fits in the groove 41 and extends along the front surface of the base 4 to contact the rear surface of the metal lamp base 3, and the bar 43 passes through the locating ring 26 of the switch base 2 without contact, and contacts closely the bent portion 220 of the L-shaped conductor 22 pushed by the spring 27.

The head 6 is cylindrical in shape and has an inner surface to receive a lens 62, a seal ring 61 and a light focusing cup 63 which fits around the lens 62. The head 6 is affixed to the front end of the body 1 with a female thread engaging a male thread on the body 1.

Batteries 7 are inserted in the body 1 behind the switch base 2, letting a conductive positive point 70 of the foremost battery contact a conductor 21 on a rear end of the switch base 2.

The tail cap 8 has a helical spring 81, and a male thread to engage a female thread of the body 1 to affix the cap 8 to the body 1.

Next, how electricity is transmitted in this flashlight is to be described. The bent portion 220 of the L-shaped conductor 22 of the switch base 2 contacts the conductive point 911 or 912 of the lamp 91 or 92 or pushes the conductive bar 43 of the plastic lamp base 4. The locating ring 26 of the switch base 2 engages the screw-in lamp 91 and pushes the flange 922 of the fit-in lamp 92. The plastic lamp base 4 has its conductive bar 43 passing through the locating ring 26 without contact with the ring 26, but contacts the conductor 22 to conduct electricity.

In order to use lamps of different styles, the straight diametrical groove 33 or 41 of the metal lamp base 3 or the plastic lamp base 4 is useful for using a screwdriver or a coin to screw the lamp base 3 or 4 in fixing a lamp.

What is claimed is:

1. A flashlight comprising:

a tubular, elongated body including a push button hole near a front end, an inner straight groove extending from the front end to the button hole for a push button of a switch base to fit into and slide along, the push button then protruding up through the button hole;

the elongated body including a female thread in the front end to engage a lamp base;

a switch base consisting of two semi-round half bodies which form a round body which is deposited in the elongated body, the switch base having an annular groove in an intermediate portion to facilitate turning the switch base, and wherein an upper semi-round half body includes point projections and a lower semi-round half body includes holes to receive the projections so that the two halves of the switch base are securely meshed;

the elongated body further including an inner cavity in its front end for a locating ring with a female thread to fit therein, said locating ring contacting a lamp secured in the lamp base so that a conductive point of the lamp is in communication with a front portion of an L-shaped conductor which is urged to a contact position with the locating ring by a spring so that electricity flows stably from batteries deposited in the tubular body to illuminate the lamp, the locating ring being constructed to accommodate multiple types of lamp bases;

a head of a cylindrical shape combined with the front end of the tubular body; and a tail cap combined with the rear end of the tubular body.

2. The flashlight of claim 1 wherein:

the lamp base is formed of metal and shaped like a round disc, and includes a male thread to engage a female thread in the front end of the tubular body, a female thread to engage a male thread of a screw-in lamp, and a straight diametric groove in a front surface to facilitate turning the base.

3. The flashlight of claim 1 wherein:

the lamp base is formed of plastic and shaped like a round disc and includes a male thread to engage the female thread in the front end of the tubular body behind the metal lamp base, a straight diametrical groove in its front surface to facilitate turning the base, a slot in a front surface to contact the rear surface of the metal lamp base, a conductive tubular bar extending rearward to pass through the locating ring in the switch base without electrical contact and to contact the bent portion of the L-shaped conductor of the switch base.

4. The flashlight of claim 1 wherein:

the locating ring is constructed so that by using multiple lamp bases, the flashlight accommodates at least three types of lamps; screw-in lamps, plug-in lamps, and fit-in lamps.

* * * * *